US006091189A

United States Patent [19]

Shinjo et al.

[11] Patent Number: 6,091,189

[45] **Date of Patent: *Jul. 18, 2000**

[54] CATHODE FOR AN ELECTRON TUBE

[75] Inventors: Takashi Shinjo; Riichi Kondo; Masato Saito; Takuya Ohira; Hiroyuki Teramoto; Kinjirou Sano, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,916

[22] Filed: Dec. 23, 1996

[30] Foreign Application Priority Data

Dec. 27, 1995 [JP] Japan ..... 7-341963
Jan. 9, 1996 [JP] Japan ..... 8-001642

[51] Int. Cl.[7] ..... H01K 1/04

[52] U.S. Cl. ..... 313/346 R; 313/346 DC

[58] Field of Search ..... 313/346 R, 346 DC, 313/446, 450–51, 270

[56] References Cited

U.S. PATENT DOCUMENTS

| | | |
|---|---|---|
| 3,031,740 | 5/1962 | Culbertson et al. . |
| 4,273,683 | 6/1981 | Kawamura . |
| 4,636,681 | 1/1987 | Misumi . |
| 5,118,984 | 6/1992 | Saito et al. . |

FOREIGN PATENT DOCUMENTS

| | | |
|---|---|---|
| 0330355A2 | 8/1989 | European Pat. Off. . |
| 0445956A2 | 9/1991 | European Pat. Off. . |
| 1120605B | 12/1961 | Germany . |
| 47-16991 | 6/1972 | Japan . |
| 56-9658 | of 1981 | Japan . |
| 56-9660 | of 1981 | Japan . |
| 57-030235A | 1/1982 | Japan . |
| 57-034631A | 2/1982 | Japan . |
| 57-52686B2 | 11/1982 | Japan . |
| 58-14017B2 | 3/1983 | Japan . |
| 1212925 | 8/1989 | Japan . |
| 3-22320A | 1/1991 | Japan . |
| 3-257735A | 11/1991 | Japan . |
| 7-107824B2 | 11/1995 | Japan . |

*Primary Examiner*—Michael H. Day
*Assistant Examiner*—Mack Haynes

[57] ABSTRACT

A cathode for an electron tube including a base body having nickel as a major component and including at least one kind of reducing agents, a metal member in a layer-like shape, which has as a major component a metal provided with a reducing power equivalent to or smaller than a reducing power of the at least one kind of reducing agents included in the base body and larger than a reducing power of nickel and which is formed on faces of the base body, an electron emitting substance layer formed by depositing alkaline earth metal oxides including barium on the metal member, wherein the metal member is formed on the faces of the base body such that the base body is restrained from deforming by thermal stresses of intermetallic compounds formed at portions of the base body bounded with the metal member.

18 Claims, 10 Drawing Sheets

CATHODE FOR AN ELECTRON TUBE

BACKGROUND OF THE INVENTION

1. Field of the Invention

The present invention relates to a cathode for an electron tube used in a cathode ray tube or the like, particularly to a structure thereof restraining a variation in the cut-off voltage of the cathode in operation thereof.

2. Discussion of the Background

CONVENTIONAL EXAMPLE 1

FIG. 7 is a view showing a conventional cathode used in a cathode ray tube for a television receiver disclosed in Japanese Unexamined Patent Publication No. 257735/1991. In FIG. 7 numeral 1 designates a metallic base body in a hat-like shape of which one end is closed and which includes small amounts of reducing elements such as silicon (Si), magnesium (Mg) and the like and whose major component is nickel (Ni) and a side wall portion thereof is fixedly welded to one end of a sleeve 4 that is provided with a substantially cylindrical shape. Numeral 2 designates an electron emitting substance layer and the electron emitting substance layer 2 is provided with the constitution in which a rare earth metal oxide 22 of a scandium oxide or the like is dispersed in a ternary alkaline earth metal oxide 21 which includes at least barium (Ba) and in addition thereto strontium (Sr) and calcium (Ca). Numeral 3 designates a heater which is arranged in the above-mentioned sleeve 4 and the metallic base body 1 is heated by heating the heater 3 whereby thermoelectrons are emitted from the electron emitting substance layer 2. Numeral 5 designates a metal layer which is formed on the metallic base body 1 and which comprises a metal having the reducing power that is smaller than the reducing power of the reducing elements included in the metallic base body and larger than the reducing power of nickel which is the major component of the metallic base body 1 and the electron emitting substance layer 2 is coated to cover the top face of the metal layer 5.

Next, an explanation will be given of a method of manufacturing the cathode for an electron tube that is constituted as above. First, a tungsten layer which is to constitute the metal layer 5 is formed on the surface of the metallic base body 1 by a thickness of 0.2 through 2 $\mu$m. Next, the electron emitting substance layer 2 is deposited thereon. The procedure of deposition is as follows. First, a ternary carbonate of barium, strontium and calcium and a predetermined amount of scandium oxide are mixed together with a binder comprising nitrocellulose and an organic solvent comprising butyl acetate whereby a suspension is prepared. The suspension is coated on the metal layer 5 that is formed on the top face of the metallic base body 1 by a spray process or the like. After the electron emitting substance layer 2 has been coated, the cathode is integrated to an electron gun and is successively heated by the heater 5 during an exhaustion step of the cathode ray tube. At this occasion, the ternary carbonate is changed into the alkaline earth metal oxide 21 by pyrolysis. After the exhaustion step the cathode is subjected to high temperature heating whereby an activation is conducted. At this occasion the activation is carried out such that a portion of the alkaline earth metal oxide 21 is reduced and the electron emitting substance layer 2 is provided with a semiconductive property whereby the electron emitting substance layer 2 comprising a mixture of the alkaline earth metal oxide 21 and the rare earth metal oxide 22 is formed on the metallic base body 1.

In this step of activation a portion of the alkaline earth metal oxide 21 reacts as follows. Namely, the reducing elements 21 such as silicon, magnesium etc. included in the metallic base body 1 are moved toward an interface between the metal layer 5 and the electron emitting substance layer 2 by diffusion where it reacts with the alkaline earth metal oxide 21. Taking an example of barium oxide (BaO) as the alkaline earth metal oxide 21 the reaction is carried out as in the following Equations 1 and (2).

$$4BaO+Si=2Ba+Ba_2SiO_4 \quad (1)$$

$$BaO+Mg=Ba+MgO \quad (2)$$

As a result of the reaction a portion of barium oxide (BaO) that is the alkaline earth metal oxide 21 deposited on the metal layer 5 is reduced to constitute an oxygen depletion type semiconductor which facilitates electron emission.

Further, the alkaline earth metal oxide 21 reacts with tungsten that is a component of the metal layer 5 as in the following Equation 3, thereby constituting similarly an oxygen depletion type semiconductor.

$$2BaO+1/3W=Ba+1/3Ba_3WO_6 \quad (3)$$

Generally, in the case of the oxide cathode, a layer comprising barium silicate ($Ba_2SiO_4$), magnesium oxide (MgO) or barium tungstate ($Ba_3WO_6$) that is a by-product formed in the above-mentioned reaction and that is referred to as an intermediate layer, is concentratingly formed at the interface between the metal layer 5 and the electron emitting substance layer 2. Accordingly, the diffusion velocities of magnesium, silicon and tungsten are restrained by the influence of the intermediate layer and as a result there causes deficiency of supply of excess barium which restricts high current density operation. Meanwhile, in the case where the rare earth metal oxide 22 is included in the electron emitting substance layer 2, taking an example of the case of a scandium oxide, at the interface between the metal layer 5 and the electron emitting substance layer 2 in operating the cathode, portions of the reducing agents which have diffused and moved through the metallic base body 1, react with the scandium oxide as in the following Equation 4 whereby a small amount of metallic scandium is formed and the metallic scandium is present at the interface.

$$1/2Sc_2O_3+3/2Mg=Sc+3/2MgO \quad (4)$$

It is conceived that the metallic scandium has an operation of decomposing components of the intermediate layer, for example, $Ba_2SiO_4$ that has been formed on the metal layer 5 as in the following Equation 5 and therefore, supply of excessive barium is improved and a higher current density operation can be conducted than in a case where the rare earth metal oxide 22 is not included. In this way the cathode for an electron tube in which the metal layer 5 is formed on the base metal 1, has an advantage in which abundance of free barium is formed and the high current density operation can be carried out.

$$1/2Ba_2SiO_4+4/3Sc=Ba+1/2Si+2/3Sc_2O_3 \quad (5)$$

According to the conventional cathode for an electron tube that is constituted as above, components of the metal layer 5 comprising tungsten that is formed on the base metal 1 comprising nickel, are made to diffuse from the surface of the metallic base metal 1 to the inner portion thereof gradually during the operation and intermetallic compounds of nickel and tungsten are formed. Therefore, a three layer structure of a pure tungsten layer, an intermetallic compound layer of nickel and tungsten and a nickel metal layer, is constituted in this order from the surface. Particularly, it is predicted that the intermetallic compound layer of nickel and tungsten that is formed in the proximity of the surface of the metallic base body 1, is provided with a small density compared with those of the other layers and therefore, the metallic base body 1 is deformed by a thermal stress concentrated on one face thereof. Hence, an interval between the first grid and the surface of the cathode is varied during long hours of operation, the cut-off voltage is varied, the brightness of the screen is gradually varied the color tone is varied for the case of a color cathode ray tube, or the like.

CONVENTIONAL EXAMPLE 2

FIG. 18 is a view showing a conventional cathode for an electron tube that is used in a cathode ray tube for a television set, an image tube or the like such as disclosed in, for example, Japanese Unexamined Patent Publication No. 257735/1991.

In FIG. 18 numeral 11 designates a base body in a disk-like shape which includes small amounts of reducing elements such as silicon (Si), magnesium (Mg) and the like and of which major component is nickel, numeral 12 designates a cathode sleeve made of Nichrome or the like, numeral 13 designates a heater arranged in the cathode sleeve 12 and numeral 14 designates a metal layer having a diameter the same as that of the base body 11, which is formed in a circular shape on all over a face of the base body 11 on the side opposed to the side of the heater 13 and of which major component is a reducing element (for example, tungsten (W) etc.) having a reducing power that is equivalent to or smaller than that of at least one of the reducing elements included in the base body 11 and higher than that of nickel.

Further, numeral 15 designates an electron emitting substance layer formed on the metal layer 14 by depositing it, of which major component is an alkaline earth metal oxide including at least barium (Ba) as well as strontium (Sr) and/or calcium (Ca) and which includes rare earth metal oxides such as scandium oxide ($Sc_2O_3$) by 0.1 through 20% by weight.

The electron emitting substance layer 15 emits thermoelectrons by heating the heater 13 arranged in the cathode sleeve 12.

An explanation will be given of methods of forming the metal layer 14 onto the base body 11 and depositing the electron emitting substance layer 15 onto the surface of the metal layer 14 with respect to the cathode for an electron tube constituted as above.

Firstly, a layer of a metal having a reducing power such as tungsten is formed by deposition on a total of a face of the base body 1 on the side thereof opposed to a control electrode (that is, on the side opposed to the heater 13) such that the film thickness becomes substantially 1 $\mu$m by the vacuum deposition process or the like and the metal layer 14 is subjected to sintering, recrystallization and diffusion to the base body by a heat treatment under a nonoxidizing atmosphere.

Next, a suspension in which a ternary carbonate of barium, strontium and calcium and a predetermined amount of a scandium oxide are mixed together with a binder and a solvent, is coated on the metal layer 14 by a thickness of about 100 $\mu$m by the spray process or the like whereby the electron emitting substance layer 15 is formed.

Next, an explanation will be given of steps from integrating the cathode for an electron tube to a cathode ray tube to enabling the electron emission.

First, the cathode for an electron tube is integrated to an electron gun along with the heater 13 for heating the cathode and after attaching it to a cathode ray tube the ternary alkaline earth metal carbonate is decomposed into oxides thereof by heating the heater 13 during a step of vacuum forming exhaustion.

Thereafter, portions of the alkaline earth metal oxides in the electron emitting substance layer 15 are reduced by the reducing agents in the base body 11 during the step of activation whereby they are converted into an oxygen depletion type semiconductor capable of emitting thermoelectrons.

According to the cathode ray tube using such a cathode for an electron tube, the higher current density operation can be performed than that using a cathode for an electron tube which does not include a scandium oxide in the electron emitting substance layer 15, or that of the cathode for an electron tube in which the metal layer 14 is not formed and a current having an average current density of 3.0 A/cm$^2$ can be taken out over a long period of time.

Incidentally, the operation is performed with the current density of 0.5 A/cm$^2$ with regard to the cathode for an electron tube which does not include a scandium oxide in the electron emitting substance layer 15 and in which the metal layer 14 is not formed and 2.0/cm$^2$ with regard to the cathode for an electron tube in which the metal layer 14 is not formed although a scandium oxide is provided to the electron emitting substance layer 15.

Next, an explanation will be given of an electron gun of a general cathode ray tube.

FIG. 19 is a conceptual view showing the outline structure of an electron gun in a general cathode ray tube. In FIG. 19 numeral 16 designates a control electrode, numeral 17 designates an accelerating electrode, numeral 18 designates a focusing electrode, numeral 19 designates a high voltage electrode integral with a display panel on which phosphors generating colors of red, green and blue are coated and numeral 20 designates a cathode for an electron tube as illustrated in FIG. 18, which is constituted by the base body 11, the cathode sleeve 12, the heater 13, the metal layer 14, the electron emitting substance layer 15 and the like.

Further, the respective electrodes each is provided with electron beam passing holes in correspondence with red, green and blue and according to a normal television apparatus using a cathode ray tube integral with such an electron gun, voltages applied on the control electrode 16, the accelerating electrode 17, the focusing electrode 18 and the high voltage electrode 19 are fixed and the current flowing out from the cathode 20 is controlled by modulating a voltage applied on the cathode per se.

For example, consider the case where the voltage of the control electrode 16 is rendered a reference. Then, 0 through the cut-off voltage is applied on the cathode 20 and a voltage of positive several hundreds V (volt) is applied on the accelerating electrode 17 and an electric field from the accelerating electrode 17 permeates through the electron beam passing hole of the control electrode 16 by modulating the voltage of the cathode 20 and bringing it proximate to the voltage of the control electrode 16 whereby electrons are emitted.

Here, the cut-off voltage is defined as a cathode voltage whereby the electron emitting current (also referred to as electron beam) starts flowing from the cathode 20 under the state where the applied voltages of the respective electrodes other than that of the cathode 20 are maintained constant.

Incidentally, the focusing electrode 18 and the high voltage electrode 19 are arranged to focus and accelerate the electron emitting current that is emitted from the cathode 20.

In the meantime one of factors determining the characteristic of a cathode ray tube is the cut-off voltage. The cut-off voltage is generally determined by three factors of the cathode 20, the control electrode 16 and the accelerating electrode 17, depends on the distances among the respective electrodes, the thicknesses of the electrodes and the shapes of the electron beam passing holes and is set to fall in a proper cut-off voltage range in accordance with the kind of the electron gun.

However, when the cathode for an electron tube in which the above-mentioned metal layer 14 is formed, the base body 11 is gradually deformed during a long period of operation of the cathode ray tube and the distance between the electron emitting substance layer 15 formed on the metal layer 14 and the control electrode 16 or the accelerating electrode 17, is varied whereby the initially set proper cut-off state cannot be maintained.

Next, an explanation will be given of the cause of the deformation of the base body 11. As described above the metal layer 14 is bondedly formed on the base body 11 and therefore, mutual diffusion of the metals constituting the base body 11 and the metals in the metal layer 14 occurs during the long period of operation and an alloy layer is formed at the interface of the bonded portion.

The coefficient of thermal expansion of the formed alloy layer is different from that of the metal of the base body 11 and therefore, the deformation of the base body 11 is caused by stress relaxation.

Incidentally, when generally different kinds of metals are bonded and a heat treatment is performed with regard thereto at high temperatures of substantially 1000° C., the metals which are mutually brought into contact with each other diffuse to each other and an alloy layer is formed with a contact face at the center of the layer.

Furthermore, the volume of the formed alloy is normally different from those of crystals of the original metals whereby the volume is expanded or contracted. With regard to an alloy of tungsten and nickel the volume is expanded and accordingly, the total of the base body 11 is bent concavely toward the side of the metal layer 14 by the interaction with the matrix of nickel as illustrated in FIG. 20.

The larger the area constituted by the formed alloy layer the more significant is the phenomenon. Accordingly, the amount of deformation increases if the metal layer covers the total face of the base body 11 as in FIG. 18.

It is conceived that the distance between the electron emitting substance layer 15 coated on the metal layer 14 on the base body 11 and the control electrode 16 is changed to make them proximate to each other as a result by the deformation of the base body and the metal layer caused by the expansion of the alloy layer.

Accordingly, the cathode is liable to receive the electric field from the accelerating electrode 17 permeating through the electron beam passing hole of the control electrode 16 and the cathode voltage which is set at the initial stage of the operation of the cathode ray tube, does not maintain the cut-off state.

Therefore, the current may flow out from the cathode 20 and the phosphor screen may generate light even in the case where the cathode is to be under the cut-off state.

According to the cathode ray tube using the cathode for an electron tube enabling the operation with the high current density under the conventional constitution, the base body 11 is deformed during the long period of operation and the cut-off voltage is considerably changed from the initial state.

Therefore, the predetermined proper cut-off characteristics with regard to electron beams of red, green and blue are not provided and unbalanced light generation or variation in brightness is caused whereby a high quality image cannot be maintained over a long period of time.

SUMMARY OF THE INVENTION

The present invention has been carried out to resolve the above-mentioned problems and it is an object of the present invention to provide a cathode for an electron tube capable of preventing deformation by thermal stress in a metallic base body during long hours of operation and applicable to a highly bright and highly fine cathode ray tube by restraining a variation in the cut-off voltage.

Also, it is an object of the present invention to provide a cathode for an electron tube capable of high current density operation with no variation in the cutoff characteristic over a long period of time.

According to a first aspect of the present invention, there is provided a cathode for an electron tube comprising:

a base body having nickel as a major component and including at least one kind of reducing agents;

a metal member in a layer-like shape, said metal member having as a major component a metal provided with a reducing power equivalent to or smaller than a reducing power of the at least one kind of reducing agents included in the base body and larger than a reducing power of nickel and said metal member being formed on faces of the base body;

an electron emitting substance layer formed by depositing alkaline earth metal oxides including barium on the metal member; and wherein the metal member is formed on the faces of the main body such that the main body is restrained from deforming by thermal stresses of intermetallic compounds formed at portions of the base body bonded with the metal member.

According to a second aspect of the present invention, there is provided the cathode for an electron tube according to the first aspect, wherein portions of the metal member are formed on an obverse face and a reverse face of the base body and the electron emitting substance layer further includes rare earth metal oxides.

According to a third aspect of the present invention, there is provided the cathode for an electron tube according to the second aspect, wherein both of the portions of the metal member formed on the obverse face and the reverse face of the base body are metal layers.

According to a fourth aspect of the present invention, there is provided the cathode for an electron tube according to the second aspect, wherein both of the portions of the metal member formed on the obverse face and the reverse face of the base body are metal powder layers.

According to a fifth aspect of the present invention, there is provided the cathode for an electron tube according to the second aspect, wherein one of the portions of the metal member formed on the obverse face and the reverse face of the base body is a metal layer and the other one thereof is a metal powder layer.

According to a sixth aspect of the present invention, there is provided the cathode for an electron tube according to the first aspect, wherein the metal member is formed to cover a portion of an obverse face of the base body and the electron emitting substance layer covers both of faces of the metal member and the obverse face of the base body.

According to a seventh aspect of the present invention, there is provided the cathode for an electron tube according to the sixth aspect, wherein the metal member is formed at a substantially central portion of the base body.

According to an eighth aspect of the present invention, there is provided the cathode for an electron tube according to the sixth aspect, wherein the metal member is formed on the obverse face of the base by dispersing the metal member in a plurality of portions thereof.

According to a ninth aspect of the present invention, there is provided the cathode for an electron tube according to the sixth aspect, wherein the metal member uses a metal in a powder-like shape having a major component of the metal provided with a reducing power equivalent to or smaller than the reducing power of the at least one kind of reducing agents included in the base body and larger than the reducing power of nickel.

According to a tenth aspect of the present invention, there is provided the cathode for an electron tube according to the sixth aspect, wherein the metal member is subjected to a heat treatment in a temperature range of 800° C. through 1,200° C. after the metal member has been formed on the obverse face of the base body.

DETAILED DESCRIPTION OF THE PREFERRED EMBODIMENTS

Embodiment 1

Figure 1:
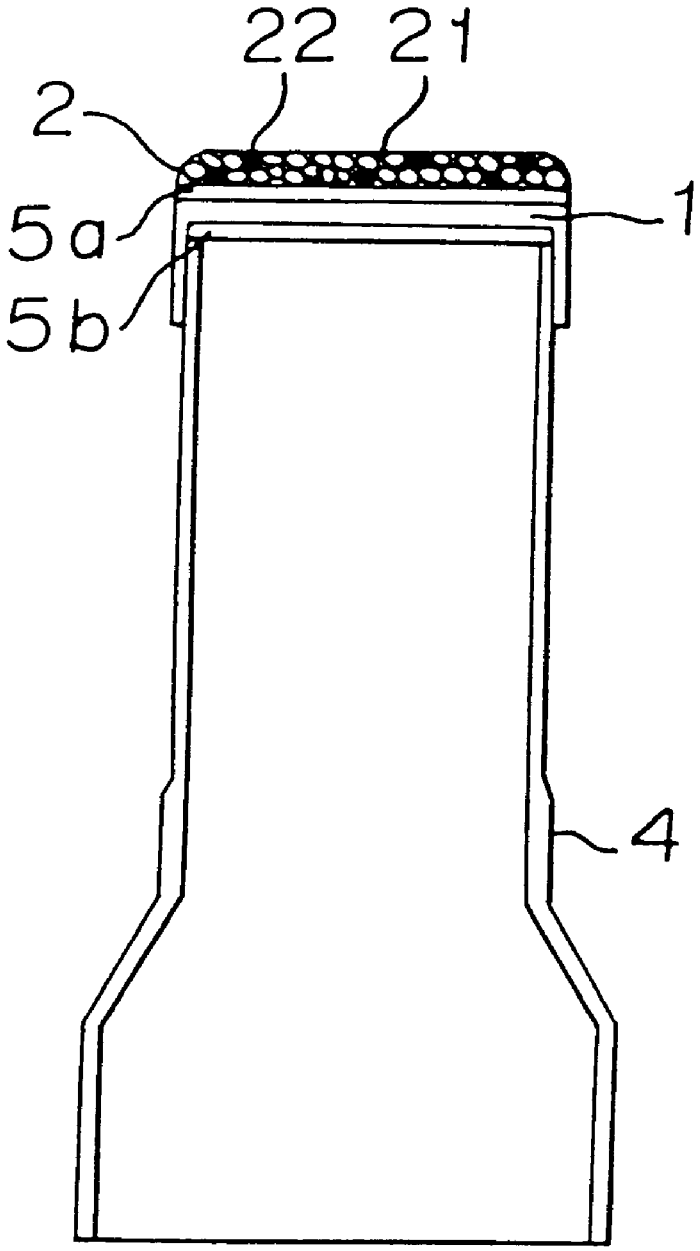
FIG. 1 is an enlarged sectional view showing a cathode for an electron tube according to Embodiment 1 of the present invention.

FIG. 1 is an enlarged sectional view showing a cathode for an electron tube that is Embodiment 1 of the present invention. In FIG. 1 numeral 1 designates a hat-like metallic base body which includes small amounts of reducing elements of silicon (Si), magnesium (Mg) etc., the major component of which is nickel (Ni), one end of which is closed and which is fixed to one end of a sleeve 4 having a substantially cylindrical shape. Numeral 2 designates an electron emitting substance layer and the electron emitting substance layer 2 has the constitution in which rare earth metal oxides 22 of a scandium oxide and the like are dispersed in alkaline metal oxides 21 including at least barium (Ba) and both or either one of strontium (Sr) and calcium (Ca). Notation 5*a* designates a metal layer constituted by tungsten deposited between one face of the metallic base body 1 and the electron emitting substance layer 2 and notation 5*b* designates a metal layer constituted by tungsten deposited on the other face of the metallic base body 1.

Next, an explanation will be given of an example of the manufacturing method of the cathode for an electron tube constituted as described above. Firstly, after cleaning the metallic base body 1, the metal layer 5*a* comprising tungsten and having a thickness of 1 $\mu$m is formed on the obverse face of the metallic base body 1 by the vapor deposition process or the sputtering process or the like in vacuum. Successively, the metal layer 5*b* comprising tungsten and having a thickness of 1 $\mu$m is similarly formed from the back side of the metallic base body 1 by the vapor deposition process or the sputtering process etc. Next, the metallic base body 1 deposited with the metal layers is welded to the sleeve 4 made of Nichrome and thereafter a heat treatment is conducted at about 1000° C. in a hydrogen atmosphere. Next, the electron emitting substance layer 2 in which a scandium oxide that is a rare earth metal oxide is dispersed in alkaline earth metal oxides by approximately 3% by weight is coated on the metal layer 5*a* that is formed on the exterior side of the metallic base body 1 by a thickness of about 80 $\mu$m through the spray process.

After the electron emitting substance layer 2 has been coated, the cathode is integrated to an electron gun and successively heated by a heater 3 in the exhausting step of a cathode ray tube. At this occasion a ternary carbonate in the electron emitting substance layer 2 is changed into alkaline earth metal oxides 21 by thermal decomposition. After the exhausting step, the assembly is heated at high temperatures whereby an activation is conducted. At this instance portions of the alkaline earth metal oxides 21 are reduced whereby the electron emitting substance layer 2 is provided with a semiconductive property by which the electron emitting substance layer 2 comprising a mixture of the alkaline earth metal oxides 21 and rare earth metal oxides 22 is formed on the metal layer 5*a*.

In this activation step portions of the alkaline earth metal oxides 21 conduct reactions as follows. The reducing elements of silicon, magnesium etc. included in the base metal 1 are moved by diffusion to an interface between the metal layer 5*a* and the electron emitting substance layer 2 and react with the alkaline earth metal 21. For example, taking an example of barium oxide (BaO) as one of the alkaline earth metal oxides 21, the reaction is conducted as in the following Equations 1 and 2.

$$4BaO+Si=2Ba+Ba_2SiO_4 \quad (1)$$

$$BaO+Mg+Ba+MgO \quad (2)$$

As a result of these reactions a portion of barium oxide (BaO) that is one of the alkaline earth metal oxide 21 deposited on the metal layer 5*a* is reduced to constitute an oxygen depletion type semiconductor thereby facilitating electron emission.

Further, the alkaline earth metal oxides react with tungsten that is a component of the metal layer 5*a* as specified by the following equation 3 to similarly constitute an oxygen depletion type semiconductor.

$$2BaO+1/3W=Ba+1/3Ba_3WO_6 \quad (3)$$

Generally, in the case of an oxide cathode byproducts of barium silicate ($Ba_2SiO_4$), magnesium oxide (MgO) and barium tungstate ($Ba_3WO_6$) which are formed in the above-described reactions and which are referred to as intermediate layers, are concentratingly formed at the interface between the metal layer 5*a* and the electron emitting substance layer 2. Accordingly, the diffusion velocities of magnesium, silicon and tungsten are restrained by the influence of the intermediate layers and as a result a deficiency of supply of excess barium is caused whereby a high current density operation is restricted. In the mean time, when the rare earth metal oxides 22 are included in the electron emitting substance layer 2, taking an example of a scandium oxide, a portion of the reducing agents diffused and moved through the metallic base body 1 and the metal layer 5*a* reacts with the scandium oxide at the interface between the metal layer 5*a* and the electron emitting substance layer 2 in operating the cathode as specified in the following Equation 4 whereby a small amount of metallic scandium is formed and the metallic scandium is present at the interface.

$$1/2Sc_2O_3+3/2Mg=Sc+3/2MgO \quad (4)$$

It is conceived that the metallic scandium has an operation of decomposing the intermediate layer formed on the metal layer 5*a*, for example, the layer of $Ba_2SiO_4$ as in the following Equation 5 and accordingly, the supply of excess barium is improved and the high current density operation is made more possible than in a case where the rare earth metal oxides 22 are not included.

$$1/2Ba_2SiO_4+4/3Sc=Ba+1/2Si+2/3Sc_2O_3 \quad (5)$$

According to the cathode for an electron tube in accordance with this embodiment, the components of the metal layers 5*a* and 5*b* comprising tungsten that is formed on the both faces of the metallic base body 1 comprising nickel, gradually diffuse from the obverse face and the reverse face of the metallic base body 1 to the inner portion thereof whereby intermetallic compounds in respect of nickel and tungsten are formed. Therefore, a three layer structure of a pure tungsten layer, an intermetallic compound layer in respect of nickel and tungsten and a nickel metal layer in this order from the obverse face or the rear face, is constituted. Especially, with regard to the intermetallic compound layer in respect of nickel and tungsten that is formed in the proximity of the obverse face or the reverse face of the metallic base body 1, the density thereof is smaller than those of the other layers. According to the conventional structure where the metal layer 5 is formed on one face thereof, the metallic base body 1 is deformed by thermal stress that is concentrated on the one face. However, according to this embodiment the metal layers 5*a* and 5*b* are provided at the both faces of the metallic base body 1 and therefore, the intermetallic compound is formed on the both faces of the metallic base body 1 and the thermal stress is applied equally on the both faces of the metallic base body 1 whereby the deformation of the metallic base body 1 is prevented.

Figure 2:
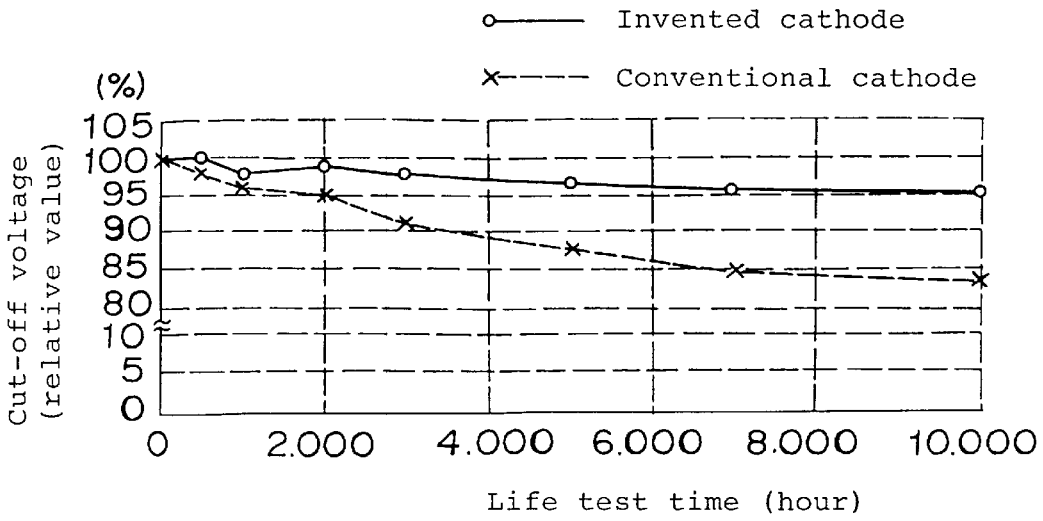
FIG. 2 is a diagram showing a coefficient of variation of the cut-off voltage during a life test of the cathode for an electron tube according to Embodiment 1 of the present invention.

FIG. 2 is a diagram showing a result of conducting the life test in which the cathode for an electron tube constituted as described above is integrated to an electron gun for a cathode ray tube and a 14 inch cathode ray tube for display having the hole diameter of the fist grid of 0.4 mm is used. As conditions of the life test the heater voltage is set to the rated value of 6.3 V, the cathode is tested under an intermittent operating condition of 2.5 hours ON and 0.5 hour OFF and the density of current flowing out from the cathode is set to 2 A/cm$^2$, In FIG. 2 the axis of abscissa designates the life test time and the axis of ordinate designates the cut-off voltage that is indicated by a relative value with the initial value determined as 100. It is known from FIG. 2 that according to the cathode for an electron tube in this embodiment the change of the cutoff voltage is smaller than that in the conventional constitution and the variation in the cut-off voltage is significantly improved.

As described above, according to this embodiment the metal layer 5*a* is formed between the electron emitting substance layer 2 including the rare earth metal oxides and the metallic base body 1 and therefore, the formation of excess barium is expedited and the high current density operation is made possible. Further, the metal layer 5*b* is formed also on the reverse face of the metallic base body 1 and therefore, equal thermal stresses are applied on the both faces of the metallic base body 1 during a long period of operation whereby the deformation of the metallic base body 1 caused by the thermal stresses can be prevented and the variation in the cut-off voltage can be restrained. Therefore, the variation in the brightness of a screen or the variation in color tone in the case of a color cathode ray tube during a long period of operation can be prevented whereby a cathode for an electron tube applicable to a highly bright and highly fine cathode ray tube can be provided.

Embodiment 2

Figure 3:
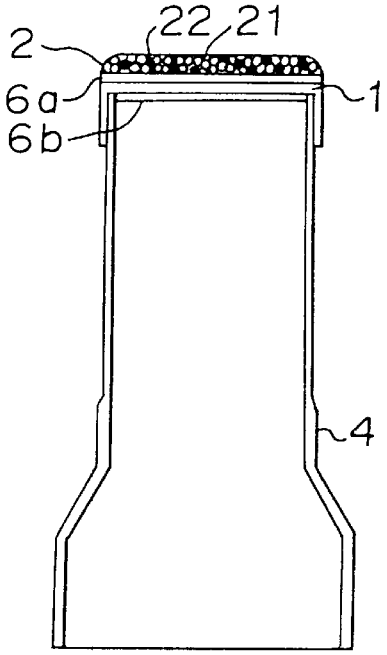
FIG. 3 is an enlarged sectional view showing a cathode for an electron tube according to Embodiment 2 of the present invention.

FIG. 3 is an enlarged sectional view showing a cathode for an electron tube in accordance with Embodiment 2 of the present invention. In FIG. 2, notation 6*a* designates a metal powder layer deposited on one face of the metallic base body 1 and notation 6*b* designates a metal powder layer deposited on the other face of the metallic base body 1. Incidentally, portions the same as or corresponding to those in FIG. 1 are attached with the same notations and the explanation will be omitted.

Next, an explanation will be given of an example of the method of manufacturing the cathode for an electron tube constituted as described above. Firstly, after welding the metallic base body 1 to the sleeve 4, the cleaning is conducted in respect thereof. Successively, a tungsten powder having a particle size of 0.5 μm through 1.0 μm is deposited on the obverse face of the metallic base body 1 by the spray process whereby the metal powder layer 6*a* having a thickness of 1 μm through 3 μm is formed. The procedure of the deposition and the formation of the metal powder layer will be explained. First, the tungsten powder is mixed with nitrocellulose that is a binder and a solution of butyl acetate that is an organic solvent and the powder is ground by a ball mill for 24 hours. Next, the powder is coated on the metallic base body 1 to constitute a thickness of approximately 2 μm by the normal spray process. Next, the metal powder layer 6*b* having a thickness of approximately 2 μm is formed by the tungsten powder similarly from the reverse side of the metallic base body 1. In this case the powder may be deposited through the spray process or by injecting a paste comprising a constant amount of the tungsten powder and a solvent into the sleeve 4. Next, the powder is subjected to a heat treatment at above 1000° C. in a hydrogen atmosphere.

Next, the electron emitting substance layer 2 formed by dispersing a scandium oxide that is a rare earth metal oxide in alkaline earth metal oxides by about 3% by weight, is coated on the metal powder layer 6*a* formed on the exterior side of the metallic base body 1 by a thickness of about 80 μm through the spray process. After coating the electron emitting substance layer 2, the cathode is integrated to an electron gun and successively the assembly is heated by the heater 3 in the exhaustion step of a cathode ray tube. At this occasion the ternary carbonate in the electron emitting substance layer 2 is changed to the alkaline earth metal oxides 21 by thermal decomposition. After the exhaustion step, the activation is conducted by heating the assembly at high temperatures. During this process portions of the alkaline earth metal oxides 21 are reduced whereby the electron emitting substance layer 2 is provided with a semiconductive property by which the electron emitting substance layer 2 comprising a mixture of the alkaline earth metal oxides 21 and the rare earth metal oxides 22 is formed on the metal powder layer 6*a*.

In this activation step, the reactions specified in Equations 1 through 5 shown in Embodiment 1 are carried out also in the cathode for an electron tube according to this embodiment.

In the cathode for an electron tube in accordance with the embodiment, intermetallic compounds in respect of nickel and tungsten which are formed when components of the metal powder layers 6*a* and 6*b* comprising tungsten, gradually diffuse from the obverse face and the reverse face to the inside of the metallic base body 1 comprising nickel, are formed on the both faces of the metallic base body 1. Therefore, thermal stresses are equally applied on the both faces of the metallic base body 1 during a long period of operation whereby the deformation of the metallic base body 1 is prevented.

Figure 4:
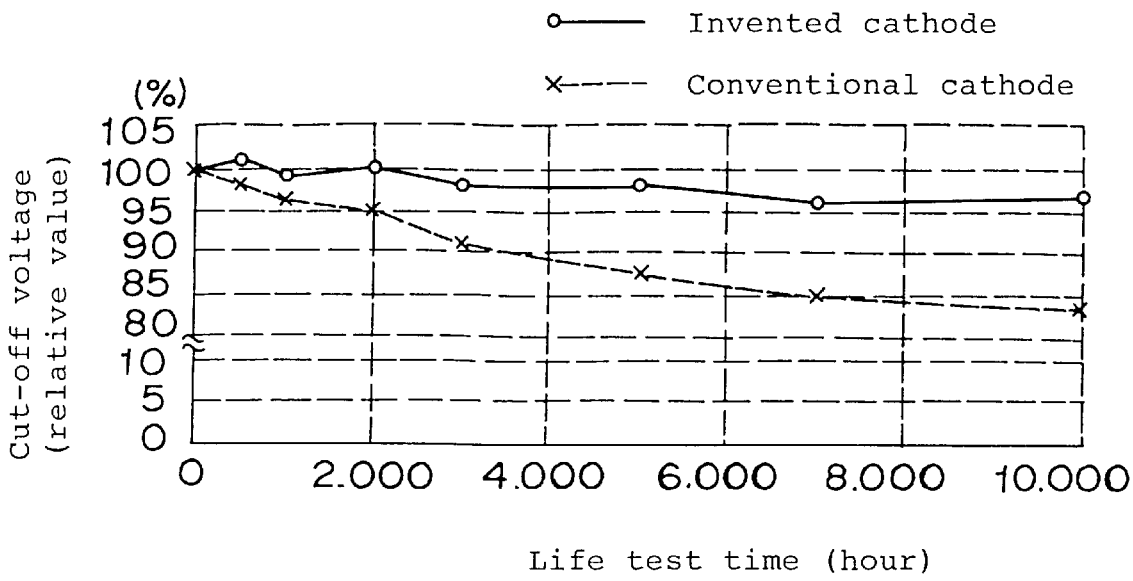
FIG. 4 is a diagram showing a coefficient of variation of the cut-off voltage during a life test of the cathode for an electron tube in accordance with Embodiment 2 of the present invention.

FIG. 4 is a diagram showing a result of conducting the life test in which the cathode for an electron tube constituted as described above is integrated to an electron gun for a cathode ray tube and a 14 inch cathode ray tube for display having the hole diameter of the first grid of 0.4 mm is used. As conditions of the life test, the heater voltage is set to the rated value of 6.3 V, the cathode is tested under an intermittent operating condition of 2.5 hours ON and 0.5 hour OFF and the density of current flowing out from the cathode is set to 2 A/cm$^2$. In FIG. 4 the axis of abscissa designates the life test time and the axis of ordinate designates the cut-off voltage which is indicated by a relative value with the initial value determined as 100. It is known from FIG. 4 that also in the cathode for an electron tube in accordance with this embodiment, the change in the cut-off voltage is smaller than that in the conventional constitution and the variation in the cutoff voltage is significantly improved as in Embodiment 1.

As described above, according to this embodiment the metal powder layer 6*a* is formed between the electron emitting substance layer 2 including the rare earth metal oxides and the metallic base body 1 and therefore, the formation of excess barium is expedited and the high current density operation is made possible. Further, also the metal powder layer 6*b* is formed on the reverse face of the metallic base body 1 and therefore, equal thermal stresses are applied on the both faces of the metallic base body 1 during a long period of operation, the deformation of the metallic base body 1 caused by thermal stresses can be prevented and the variation in the cut-off voltage can be restrained. Therefore, the variation in the brightness of a screen or the variation in the color tone in the case of a color cathode ray tube during a long period of operation can be prevented and the cathode for an electron tube applicable to a highly bright and highly fine cathode ray tube can be provided.

Embodiment 3

Figure 5:
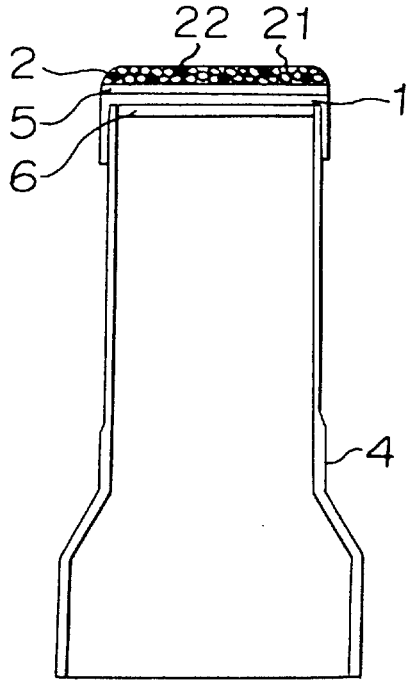
FIG. 5 is an enlarged sectional view showing a cathode for an electron tube in accordance with Embodiment 3 of the present invention.

FIG. 5 is an enlarged sectional view showing a cathode for an electron tube in accordance with Embodiment 3 of the present invention. In FIG. 5 numeral 5 designates a metal layer deposited between one face of the metallic base body 1 and the electron emitting substance layer 2. Numeral 6 designates a metal powder layer deposited on the other face of the metallic base body 1. Incidentally, portions the same as or corresponding to those in FIG. 1 are attached with the same notations and the explanation will be omitted.

Next, an explanation will be given of an example of the method of manufacturing the cathode for an electron tube constituted as described above. Firstly, after welding the metallic base body 1 to the sleeve, the cleaning is conducted in respect thereof. Successively, the metal layer 5 comprising tungsten and having a thickness of 1 μm is formed on the obverse face of the metallic base body 1 through the vapor deposition process or the sputtering process in vacuum. Next, a tungsten powder having a particle size of 0.5 μm through 1.0 μm is deposited on the reverse face of the metallic base body 1 by the spray process whereby the metal powder layer 6 having a thickness of 1 μm through 3 μm is formed. The procedure of depositing the metallic base body will be explained. Firstly, the tungsten powder is mixed with nitrocellulose that is a binder and a solution of butyl acetate that is an organic solvent and the powder is ground by a ball mill for 24 hours. Next, the powder is coated on the reverse side of the metallic base body 1 to constitute a thickness of about 2 μm through the normal spray process. The coating step can be carried out by depositing the powder by the spray process or by injecting a paste comprising a constant amount of the tungsten powder and a solvent into the sleeve 4. Next, the powder is subjected to a heat treatment at about 1000° C. in a hydrogen atmosphere. Next, after coating the electron emitting substance layer 2 on the metal layer 5 formed on the exterior side of the metallic base body 1 through the spray process, the assembly is integrated to an electron gun and is heated by the heater 3 in the exhaustion step of a cathode ray tube and further, the activation process is carried out by heating the assembly at high temperatures. In this activation step the reactions as specified in Equations 1 through 5 described in the above-described Embodiment 1 are carried out also in the cathode for an electron tube in accordance with this embodiment.

According to the cathode for an electron tube in accordance with this embodiment, the intermetallic compounds in respect of nickel and tungsten which are formed when components of the metal layer 5 comprising tungsten and the metal powder layer 6 diffuse from the obverse face and the reverse face to the inside of the metallic base body 1 comprising nickel, are formed on the both faces of the metallic base body 1. Therefore, thermal stresses are applied equally on the both faces of the metallic base body 1 during a long period of operation whereby the deformation of the metallic base body 1 is prevented.

Figure 6:
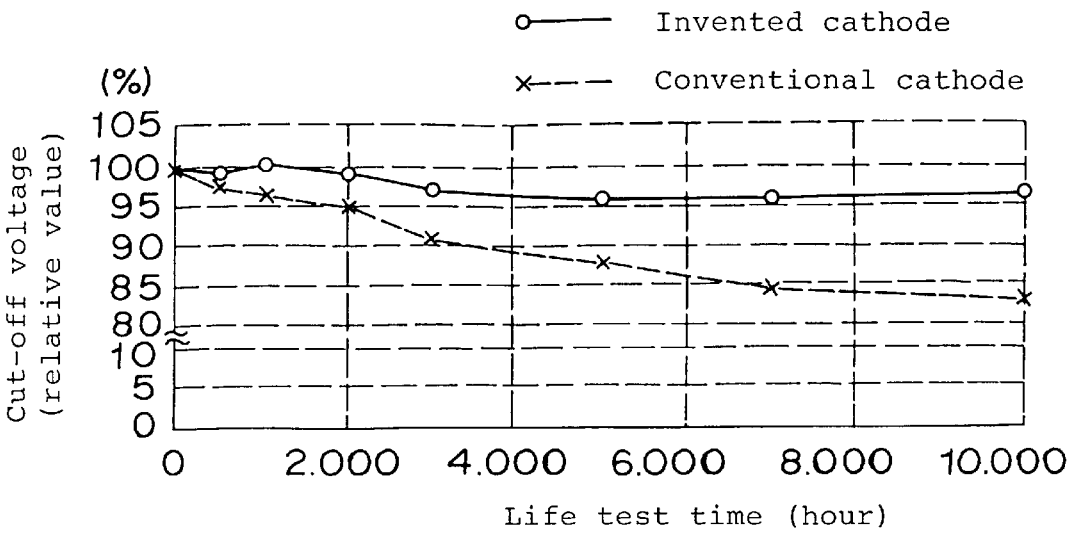
FIG. 6 is a diagram showing a coefficient of variation of the cut-off voltage during a life test of the cathode for an electron tube in accordance with Embodiment 3 of the present invention.
Figure 7:
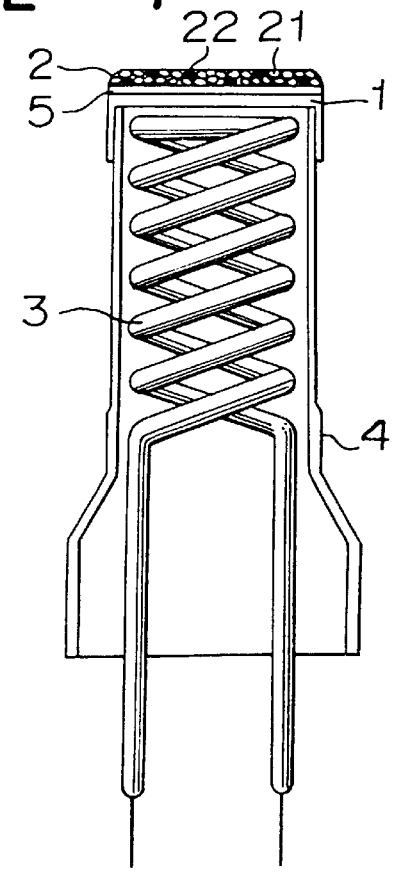
FIG. 7 is an enlarged sectional view showing a cathode for an electron tube in accordance with Conventional Example 1.

FIG. 6 is a diagram showing a result of the life test in which the cathode for an electron tube constituted as described above is integrated to an electron gun for a cathode ray tube and a 14 inch cathode ray tube for display having the hole diameter of the first grid of 0.4 mm is used. As conditions of the life test, the heater voltage is set to the rated value of 6.3 V, the cathode is tested under an intermittent operating condition of 2.5 hours ON and 0.5 hour OFF and the density of current flowing out from the cathode is set to 2 $A/cm^2$. In FIG. 6 the axis of abscissa designates the life test time and the axis of ordinate designates the cut-off voltage which is indicated by a relative value with the initial value determined as 100. It is known from FIG. 6 that the change in the cut-off voltage is smaller than that in the conventional constitution and the variation in the cut-off voltage is significantly improved also in the cathode for an electron tube in accordance with this embodiment as in Embodiment 1 and Embodiment 2.

As described above, according to this embodiment the metal layer 5 is formed between the electron emitting substance layer including the rare earth metal oxides and the metallic base body 1 and therefore, the formation of excess barium is expedited and the high current density operation is made possible. Furthermore, the metal powder layer 6 is formed also on the reverse face of the metallic base body 1 and therefore, thermal stresses are applied equally on the both faces of the metallic base body 1 during a long period of operation, the deformation of the metallic base body 1 caused by the thermal stresses can be prevented and the variation in the cutoff voltage can be restrained. Therefore, the variation in the brightness of a screen, or the variation in the color tone in the case of a color cathode ray tube during a long period of operation can be prevented and the cathode for an electron tube applicable to a highly bight and highly fine cathode ray tube can be provided.

Incidentally, according to this embodiment the metal layer 5 is formed between the electron emitting substance layer 2 and the obverse face of the metallic base body 1 and the metal powder layer 6 is formed on the reverse face of the metallic base body 1. However, a similar effect can be provided by a combination in which the metal powder layer is interposed between the electron emitting substance layer 2 and the metallic base body 1 and the metal layer is formed on the reverse face of the metallic base body 1.

Further, according to Embodiments 1 through 3, small amounts of the reducing metals of silicon (Si) and magnesium (Mg) are included in the metallic base body the major component of which comprises nickel. However, a similar effect can be provided also in the case where a reducing metal of either one of silicon and magnesium is used. Further, tungsten (W) is indicated as an example of the component of the metal layer or the metal powder layer the reducing power of which is smaller than or equal to that of the reducing agents in the metallic base body and the reducing power of which is larger than nickel in the metallic base body. However, the component is not limited to tungsten but a similar effect is achieved by using a metal of molybdenum (Mo), tantalum (Ta), chromium (Cr) etc. as the component.

Embodiment 4

An explanation will be given of Embodiment 4 of the present invention in reference to the drawings as follows. Portions the same as those in Conventional Example 2 represent the same or the corresponding portions.

Figure 8:
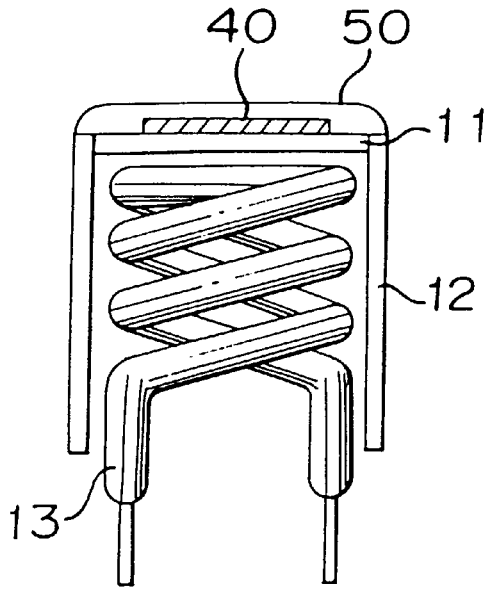
FIG. 8 is a view showing the structure of a cathode for an electron tube in accordance with Embodiment 4 of the present invention.

FIG. 8 is a view showing the outline structure of a cathode for an electron tube in accordance with Embodiment 4 of the present invention.

In FIG. 8, numeral 11 designates the base body in a disk-like shape which includes small amounts of reducing elements such as silicon (Si), magnesium (Mg) etc., the major component of which is nickel, numeral 12 designates the cathode sleeve which is constituted by a cylindrical material of Nichrome etc., to one end of which the base body 11 is fixed and numeral 13 designates the heater arranged in the cathode sleeve 12.

Numeral 40 designates a metal layer which has a diameter smaller than the diameter of the base body 11 and which is formed in a circular form at the central portion on one face of the disk-like base body 11 opposed to a side of the heater 13. The metal layer 40 has the major component of a reducing element the reducing power of which is equal to or smaller than at least one of reducing elements included in the base body 1 and is larger than that of nickel (for example, tungsten (W) etc.).

Numeral 50 designates an electron emitting substance layer that is formed by being deposited to cover surfaces of the metal layer 40 and a total of a surface of the base body 1 at the outer peripheral portion of the metal layer 40. The electron emitting substance layer 50 includes at least barium (Ba), the major component of the layer is constituted by alkaline earth metal oxides including strontium (Sr) and/or calcium (Ca) and the layer includes rare earth metal oxides of scandium oxide ($Sc_2O_3$) etc. by 0.1 through 20% by weight.

The electron emitting substance layer 50 emits thermoelectrons by heating it by the heater 13 arranged in the cathode sleeve 12.

Next, an explanation will be given of an example of the method of manufacturing the cathode for an electron tube constituted as described above. Firstly, the base body 11 constituted by the disk-like metal material is fixed to one end of the cathode sleeve 12 made of Nichrome by welding, thereafter the assembly is cleaned and a metal the major component of which is constituted by a reducing element of tungsten or the like, is deposited by the vapor deposition process on the metal surface of the base body 11 in a shape of a disk which is concentric with the base body 11 and the diameter of which is smaller than the diameter of the base body 11 in vacuum whereby the metal layer 40 is formed.

Next, the assembly is subjected to a heat treatment at a temperature of, for example, about 1000° C. in a hydrogen atmosphere.

Incidentally, as an example, the diameter of the base body 11 is set to 1.5 mm, the diameter of the metal layer 40 is set to 0.5 mm that is the same as the diameter of a hole for passing an electron beam in the control electrode 16 and the thickness of vapor deposition of the metal layer 40 is set to 1 $\mu$m.

Next, a scandium oxide that is a rare earth metal oxide is mixed with carbonates of alkaline earth metals including barium, strontium and calcium by about 3% by weight, a suspension in which the above-described mixture is mixed in a solvent comprising nitrocellulose and butyl acetate alcohol is prepared and the electron emitting substance layer 50 having a thickness of about 100 $\mu$m is formed by the spray process to cover the surfaces of the metal layer 40 and the total of the surface of the base body 11 surrounding the outer peripheral portion of the metal layer 40.

Next, an explanation will be given of the structure of an electron gun and the method of manufacturing thereof.

Firstly, the heater 13 for heating is arranged in the cathode sleeve 12 of the above-described cathode for an electron tube and an electron gun in which the control electrode 16, the accelerating electrode 17, the focusing electrode 18 and the high voltage electrode 19 are integrally assembled while maintaining an insulative performance by an insulating maintaining material, is manufactured.

Here, the diameter of the electron beam passing hole of the control electrode 16 is set to 0.5 mm.

Thereafter, the electron gun is enclosed in a cathode ray tube and the alkaline earth metal carbonates in the electron emitting substance layer 50 are decomposed into alkaline earth metal oxides by heating them by the heater 13 in the exhaustion step.

Furthermore, portions of the alkaline earth metal oxides are reduced into alkaline earth metals by the metal of the base body 11 and the reducing elements in the metal layer 40 in this activation step thereby forming an electron emitting source.

Figure 9:
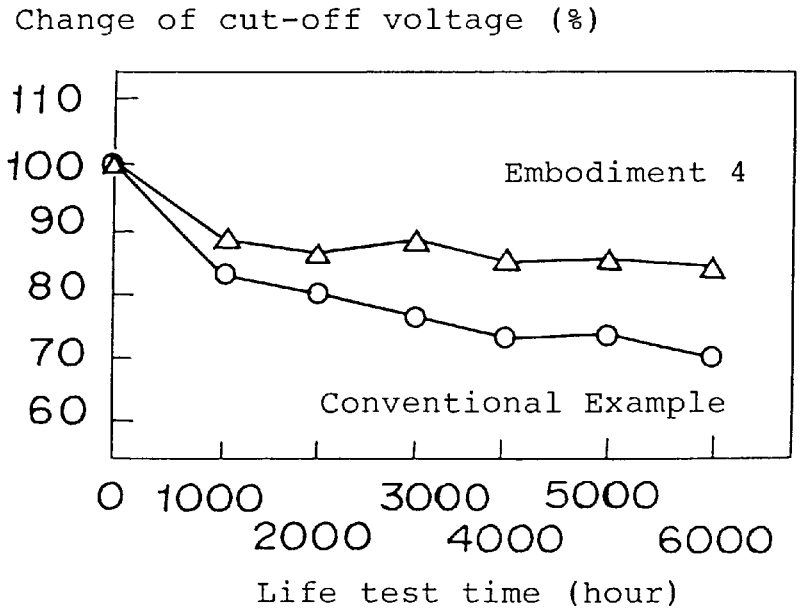
FIG. 9 is a diagram showing a variation of the cut-off voltage during a life test of the cathode for an electron tube in accordance with Embodiment 4 of the present invention.

FIG. 9 shows a result of the life test of a cathode ray tube that is manufactured by using the cathode for an electron tube in accordance with Embodiment 4. As conditions of the life test, the heater voltage is set to the rated value of 6.3 V and current is conducted to the heater under an intermittent current conduction in which current is conducted for 2.5 hours and current is not conducted for 0.5 hour. Further, the density of current flowing out from the cathode is set to 2 $A/cm^2$.

In FIG. 9 the axis of abscissa designates the life test time and the axis of ordinate designates the cut-off voltage which is indicated by a relative value with the initial value of the cut-off voltage determined as 100.

No hindrance is caused practically if the variation of the cut-off voltage is within about 20% (that is, 80% or more when the initial value is set to 100%). As is apparent from FIG. 9, it is known that according to the cathode ray tube using the cathode for an electron tube in accordance with Embodiment 4, the aging change of the cut-off voltage after the cathode ray tube has been operated for a long period of time, is much improved compared with that in the conventional constitution.

Incidentally, although the conventional cathode is provided with the constitution basically similar to that in this embodiment, the diameter of the metal layer 14 formed on the base body 11 is set to 1.5 mm that is equal to the diameter of the base body 11.

Next, an explanation will be given to the reason for the improvement and effect by Embodiment 4. As described above, generally, when different metals are bonded and a heat treatment is conducted at temperatures as high as about 1000° C., metals in contact with each other mutually diffuse and an alloy layer is formed centering on the contact face.

Further, normally, the volume of the formed alloy is different from those of crystal forms in the original metals whereby expansion or construction is caused. In the case of the alloy of the reducing element such as tungsten etc. that is the major component of the metal layer 40 and nickel that is the major component of the base body 11, expansion is caused and therefore, the total of base body is bent protruding to the side of the metal layer due to the operation of the reducing element in respect of nickel constituting the matrix.

Figure 10:
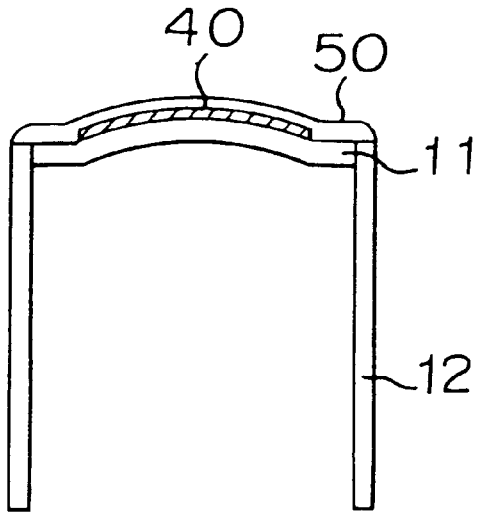
FIG. 10 is a view showing a section of the cathode for an electron tube in accordance with Embodiment 4 of the present invention after the life test.

According to this embodiment similar to Conventional Example 2, the alloy layer is formed at the interface between the metal of the base body 11 and the metal layer 40. However, the metal layer 40 is formed at a portion of the central portion of the base body 11 and accordingly, the area in which the alloy layer is formed is smaller than that in the Conventional Example 2 and therefore, the amount of deformation of the base body 1 is smaller than that in the Conventional Example 2 as illustrated in FIG. 10.

Accordingly, the interval between the electron emitting substance layer 50 formed on the metal layer 40 and the control electrode 16 is difficult to vary in comparison with that in the Conventional Example 2 and as a result the cathode for an electron tube having a smaller aging variation in the cut-off voltage can be realized.

Embodiment 5

Figure 11:
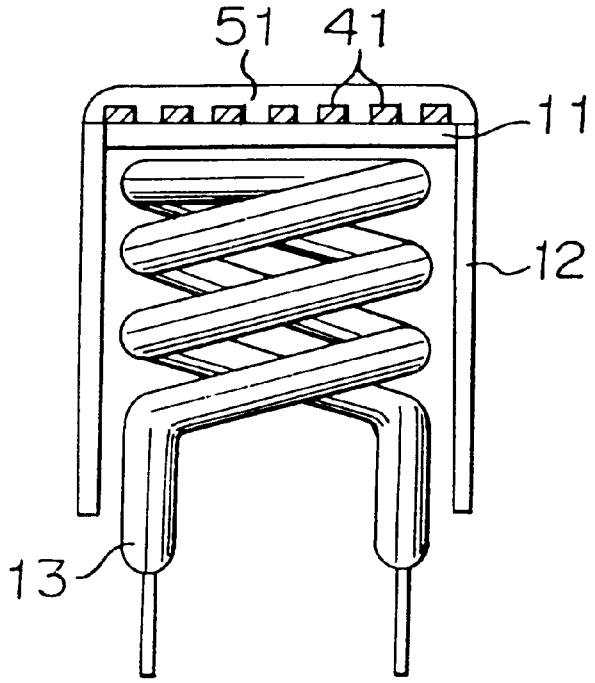
FIG. 11 is a view showing the structure of a cathode for an electron tube in accordance with Embodiment 5 of the present invention.

FIG. 11 is a view showing the structure of a cathode for an electron tube in accordance with Embodiment 5 of the present invention. The basic structure and the manufacturing steps are substantially the same as those in the above-described Embodiment 4.

In FIG. 11 numeral 11 designates the base body in a disk-like shape which includes small amounts of reducing elements of silicon (Si), magnesium (Mg) etc., the major component of which comprises nickel and numeral 12 designates the cathode sleeve which is constituted by a substantially cylindrical material of nickel etc., to one end of which the base body 11 is fixed and numeral 13 designates the heater arranged in the cathode sleeve 12.

Further, numeral 41 designates a plurality of metal layers which are dispersingly formed by the vacuum deposition process over the entire obverse face of the base body 11 that is masked by a mesh screen on the obverse face of the disk-like base body 11 on a side opposed to a side of the heater 13 and the metal layers 41 each has the major component of a reducing element the reducing power of which is equal to or smaller than that of at least one of reducing elements included in the base body 11 and larger than that of nickel (for example, tungsten (W) etc.).

Here, the deposited thickness of the metal layer 41 formed by the vapor deposition process is about 1 $\mu$m and a screen of 100 mesh is used for the masking operation.

Further, numeral 51 designates an electron emitting substance layer that is formed by being deposited to cover the entire faces of the metal layers 41 in a mesh-like shape and portions of the faces of the base body 11 where the metal layers 41 are not formed and the electron emitting substance layer 51 has the major component of alkaline earth metal oxides including at least barium (Ba) and in addition thereto strontium (Sr) and/or calcium (Ca), and includes rare earth metal oxides of scandium oxide ($Sc_2O_3$) etc. by 0.1 through 20% by weight.

The electron emitting substance layer 51 emits thermoelectrons by heating it by the heater 3 arranged in the cathode sleeve 2.

Figure 12:
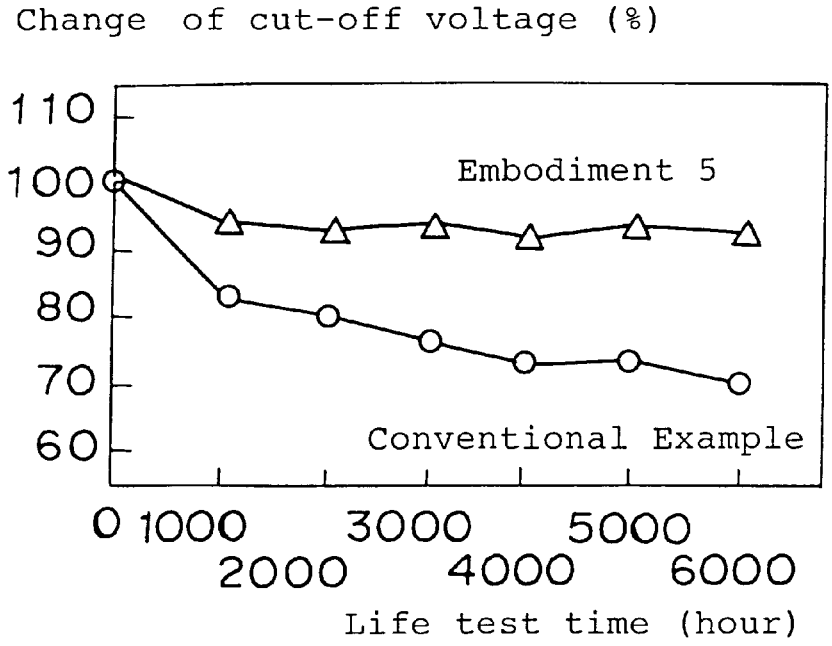
FIG. 12 is a diagram showing a variation of the cut-off voltage during a life test of the cathode for an electron tube in accordance with Embodiment 5 of the present invention.

FIG. 12 shows a result of the life test of a cathode ray tube manufactured by using the cathode for an electron tube in accordance with Embodiment 5.

As conditions of the life test, the heater voltage is set to the rated value of 6.3 V and electricity is conducted to the heater in an intermittent electricity conducting conduction in which electricity is conducted for 2.5 hours and electricity is not conducted for 0.5 hour. Also, the density of current flowing out from the cathode is set to 2 A/cm$^2$.

Similar to FIG. 9, also in FIG. 12 the axis of abscissa designates the life test time and the axis of ordinate designates the cut-off voltage which is indicated by a relative value with the initial value of the cut-off voltage determined as 100.

As is apparent from FIG. 12, it is known that also according to the cathode ray tube using the cathode for an electron tube in accordance with Embodiment 5 the aging change of the cut-off voltage during a long period of operation is much improved in comparison with that of the conventional constitution.

Incidentally, the cathode in Comparative Example 2 has the structure basically similar to that in this embodiment and the diameter of the metal layer 14 formed on the base body 11 is 1.5 mm that is equal to diameter of the base body 11.

Next, an explanation will be given of the reason that the aging variation of the cut-off voltage of the cathode ray tube using the cathode for an electron tube in accordance with Embodiment 5 is smaller than that in Conventional Example 2.

Figure 13:
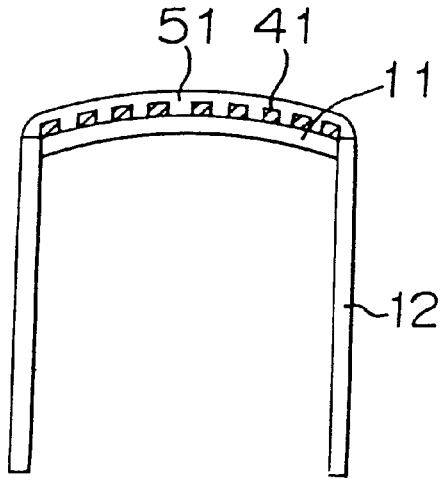
FIG. 13 is view showing a section of the cathode for an electron tube in accordance with Embodiment 5 of the present invention after the life test.

FIG. 13 is the outline view of the sections of the base body 11 and metal layer 41 after conducting the life test. The metal layer 41 is not formed on the entire face of the base body 11 as in Conventional Example 2 but the plurality of portions of the metal layer 41 are dispersingly provided in this embodiment. Therefore, similar to the case of Embodiment 4, the area of the alloy layer formed by alloying the reducing metals such as tungsten etc. which constitute the major component of the metal layer 41 and nickel that is the major component of the base body 11, becomes smaller and therefore, it is conceived that the degree of bending of the base body 11 caused by the alloying phenomenon is restrained and as a result the variation in the cut-off voltage is decreased.

Embodiment 6

Figure 14:
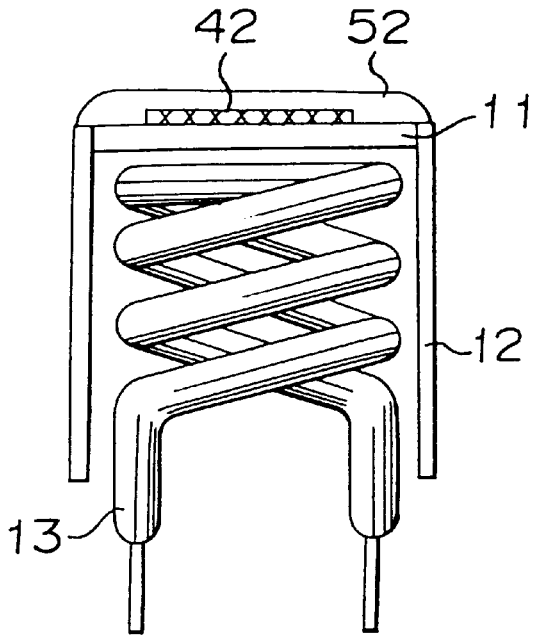
FIG. 14 is view showing the structure of a cathode for an electron tube in accordance with Embodiment 6 of the present invention.

FIG. 14 is a view showing the structure of a cathode for an electron tube in accordance with Embodiment 6 of the present invention. The basic constitution and the manufacturing steps thereof are substantially the same as those in the above-mentioned Embodiment 4 or 5.

In FIG. 14 numeral 11 designates the disk-like base body which includes small amounts of reducing elements of silicon (Si), magnesium (Mg) etc., the major component of which comprises nickel, numeral 12 designates the cathode sleeve which is constituted by a substantially cylindrical Nichrome material etc., to one end of which the base body 11 is fixedly installed and numeral 13 designates the heater arranged in the cathode sleeve 12.

Further, numeral 42 designates a metal powder layer formed in a circular shape at the central portion of the disk-like basic body 11 on an obverse face thereof on the side opposed to the side of the heater 13, which is provided with the diameter smaller than the diameter of the base body 11. The major component of the metal powder layer 42 is a reducing element having the reducing power that is equal to or less than that of at least one of reducing elements included in the base body 1 and larger than that of nickel (for example, tungsten (W) etc.).

Further, the metal powder used in this metal powder layer 42 is constituted by tungsten particles each having, for example, the mean particle size of approximately 1 $\mu$m.

Further, the thickness of the metal powder layer 42 is about 2 $\mu$m and the metal powder layer 42 is coated at the central portion on the substrate 11 in a circular shape with the diameter of about 0.5 mm by using the spray process.

Embodiment 6 is characterized in that the metal layer 40 in the above-mentioned Embodiment 4 is replaced by the metal powder layer 42.

Also, numeral 52 designates an electron emitting substance layer that is formed by being deposited to cover the total of the faces of the above-described metal powder layer 42 and the base body 11, the major component of which is constituted by alkaline earth metal oxides including at least barium (Ba) and in addition thereto strontium (Sr) and/or calcium (Ca) and which includes rare earth metal oxides of scandium oxide ($Sc_2O_3$) etc. by 0.1 through 20% by weight. The electron emitting substance layer 52 emits thermoelectrons by heating it by the heater 13 arranged in the cathode sleeve 12.

Figure 15:
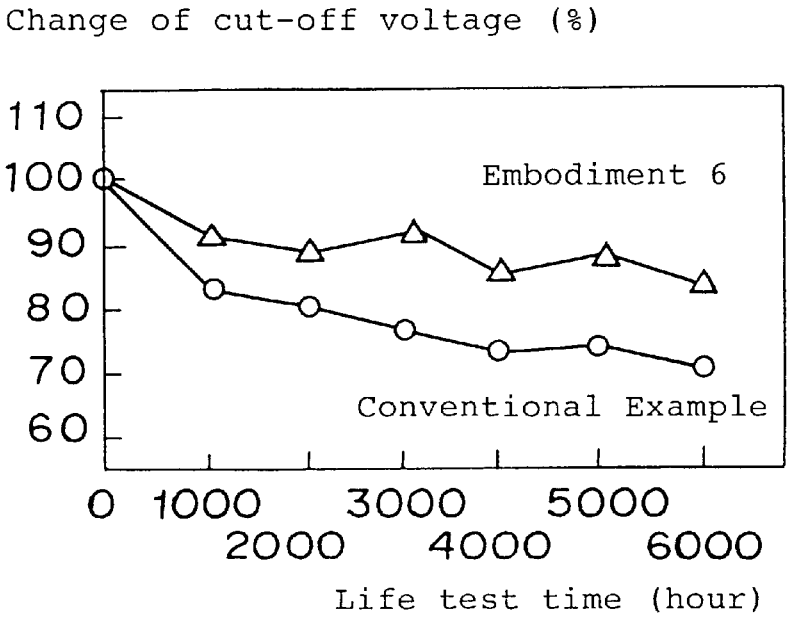
FIG. 15 is a diagram showing a variation of the cut-off voltage during a life test of the cathode for an electron tube in accordance with Embodiment 6 of the present invention.

FIG. 15 shows results of the life test of a cathode ray tube manufactured by using the cathode for an electron tube in accordance with Embodiment 6.

As conditions of the life test, the heater voltage is set to the rated value of 6.3 V and the cathode is tested under an intermittent operating condition of 2.5 hours ON and 0.5 hour OFF. Further, the density of current flowing out from the cathode is set to 2 A/cm$^2$.

Similar to FIG. 9 or FIG. 12, also according to FIG. 15 the axis of abscissa designates the life test time and the axis of ordinate designates the cut-off voltage which is indicated by a relative value with the initial value determined as 100.

As is apparent from FIG. 15 according to the cathode ray tube using the cathode for an electron tube in accordance with Embodiment 6 the aging change of the cut-off voltage after a long period of operation is found to be much improved compared with the cathode of Conventional Example 2.

Next, an explanation will be given of the reason that the aging variation of the cut-off voltage of the cathode ray tube using the cathode for an electron tube in accordance with Embodiment 6 is smaller than that in Conventional Example 2.

Figure 16:
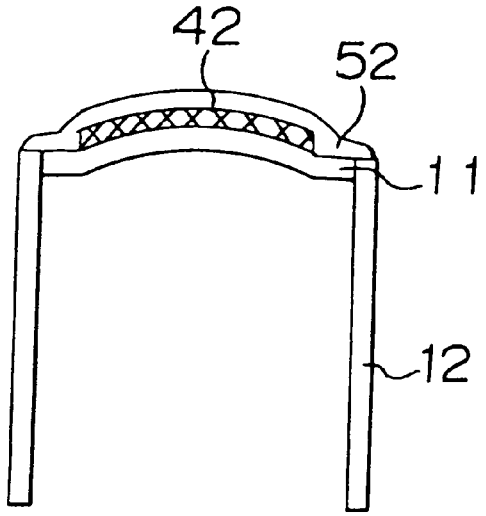
FIG. 16 is a view showing a section of the cathode for an electron tube in accordance with Embodiment 6 of the present invention after the life test.

FIG. 16 is the outline sectional view of the base body 11 and the metal powder layer 42 after the life test. Contrary to the metal layer in the Conventional Example 2 in which the metal layer is formed over the entire face of the disk body, the metal powder layer 42 is confined to the central portion of the base body 11 having the diameter of approximately 0.5 mm. Therefore, it is conceived that the area of bending of the base body 11 which is caused by alloying tungsten that is the major component of the metal powder layer and nickel that is the major component of the base body 11 is reduced and accordingly, the degree of bending of the base body 11 caused by the alloying phenomenon is restrained and as a result the variation in the cut-off voltage during a long period of operation of the cathode ray tube is reduced.

Embodiment 7

Figure 17:
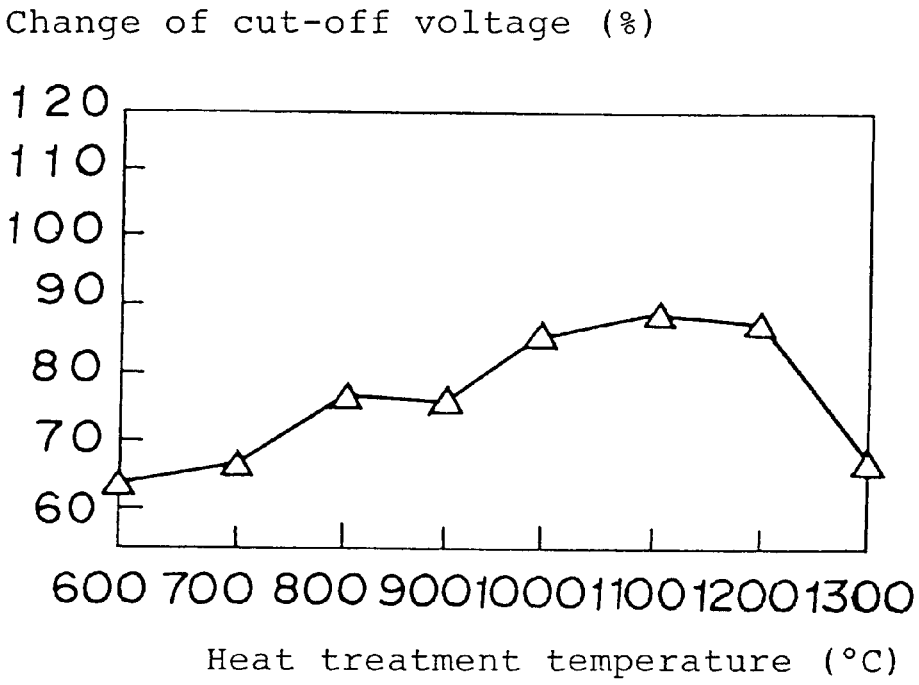
FIG. 17 is a diagram showing a change in the cut-off voltage after the life test in respect of a heat treatment temperature in accordance with Embodiment 7 of the present invention.
Figure 18:
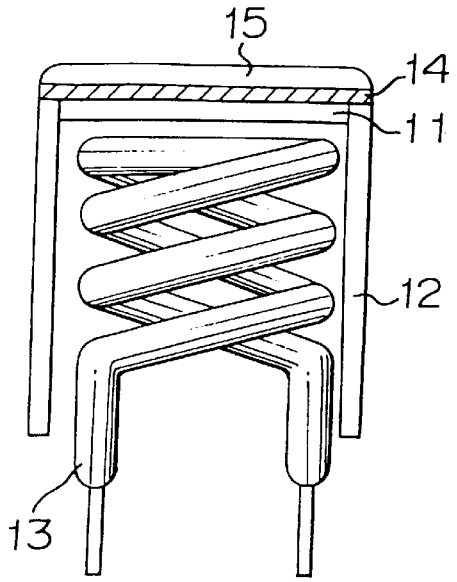
FIG. 18 is a view showing the structure of a cathode for an electron tube in accordance with Conventional Example 2.
Figure 19:
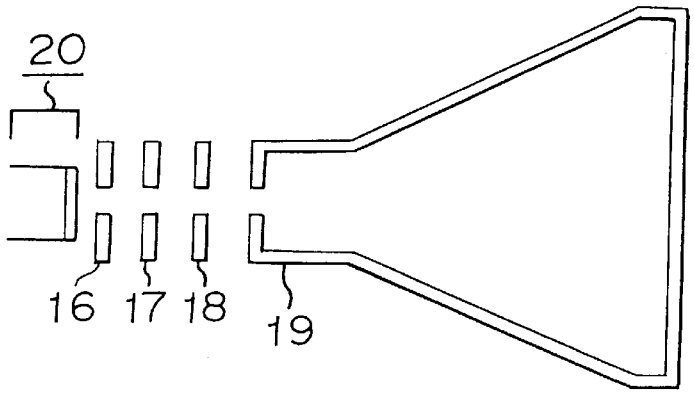
FIG. 19 is a conceptual view for explaining an electron gun of a cathode ray tube.
Figure 20:
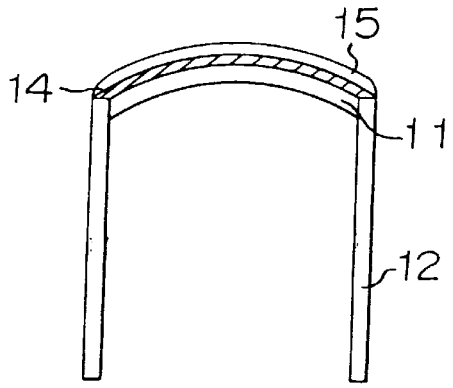
FIG. 20 is a view showing a section of a cathode for an electron tube in accordance with Conventional Example 2 after the life test.

FIG. 17 shows the degree of variation in the cut-off voltage after the life test (after 6000 Hr) of a cathode ray tube, which is indicated with the initial value determined as 100 and in which the temperature of heat treatment conducted after the formation of the metal layer on the base body, is changed.

Here, although the constitution, the manufacturing steps and the test conditions are the same as those in Embodiment 4, the heat treatment is carried out at the heat treatment temperature of 600° C. through 1300° C. in a hydrogen atmosphere. According to the test result shown in FIG. 17, it is found that the variation in the cut-off voltage is small to an extent posing no problem in the practical point of view in the range of 1000° C. through 1200° C. and the variation is further reduced in the range of 1000° C. through 1200° C.

Also, it can be confirmed that the similar effect is provided to Embodiment 5 and Embodiment 6.

Next, an explanation will be given of the reason that when different metal layers are bonded and heat which is generated in operating a cathode ray tube is applied to metal layers, as mentioned above an alloy layer is formed in the proximity of the bonding face, the crystal structure is changed and accordingly deformation is caused by expansion or contraction.

However, it is conceived that the deformation due to the alloy layer is previously caused by the heat treatment at the stage of the cathode before integrating to an electron gun and not caused in operating the cathode ray tube and the deformation after integrating the cathode to the cathode ray tube is stabilized to the extent posing no problem whereby the change in the cut-off voltage is more reduced than that in the conventional case.

Incidentally, the stabilization can be achieved by conducting the heat treatment after the formation of the metal layer at high temperatures. A deterioration of the characteristic is caused at the heat treatment temperature exceeding 1200° C. since a thermal deformation is caused at the temperature because nickel is used as the major component of the base body metal.

As described above, according to the cathode for an electron tube in accordance with the present invention, in the cathode for an electron tube having the base body the major component of which comprises nickel and which includes at least one kind of reducing agents, the metal layer the major component of which is a metal the reducing power of which is equal to or less than at least one of the reducing agents included in the base body and larger than that of nickel and an electron emitting substance layer that is formed by depositing alkaline earth metal oxides including barium on the metal layer, the metal layer is formed such that the metal layer covers a portion of the surface of the base body and the electron emitting substance layer is formed to cover both of the surfaces of metal layer and the base body, whereby the variation in the cut-off voltage of an electron tube such as a cathode ray tube which is caused by the aging deformation of the base body and the electron emitting substance layer formed on the base body. Therefore, the invention has an effect capable of providing the high quality cathode for an electron tube whereby unbalance of coloring or the variation in the brightness is not caused over a long period of operation.

Further, the metal layer of the cathode for an electron tube in accordance with the present invention is subjected to the heat treatment in the temperature range of 1000° C. through 1200° C. after it is formed on the surface of the base body and the deformation caused by the alloy layer at the bonding portion of the base body and the metal layer, is previously caused by the heat treatment at the stage of manufacturing the cathode before integrating it to an electron gun and not caused in operating the electron tube. Therefore, the change in the cut-off voltage in the long period of operation of the electron tube thereafter can be improved into a further stabilized state.

What is claimed is:

1. An indirectly heated cathode for an electron tube comprising:

a base body having nickel as a major component and including at least one kind of reducing agent;

a metal member in a layer-like shape, said metal member having as a major component a metal provided with a reducing power equivalent to or smaller than a reducing power of the at least one kind of reducing agents included in the base body and larger than a reducing power of nickel and said metal member being formed on faces of the base body;

an electron emitting substance layer formed by depositing alkaline earth metal oxides including barium on the metal member;

wherein the metal member is formed on the faces of the base body such that the base body is restrained from deforming by thermal stresses of intermetallic compounds formed from diffusion of metals between the base body and the metal members on the faces thereof at portions of the base body bounded with the metal member, said reducing agent in said base body forming an interface between said metal member and said electron emitting substance layer which reacts with said alkaline earth metal oxides to further reduce a portion of the alkaline earth metal oxides and form an oxygen depletion-type semiconductor, thereby facilitating the emission of electrons.

2. The cathode for an electron tube according to claim 1, wherein portions of the metal member are formed on an obverse face and a reverse face of the base body and the electron emitting substance layer is formed on a metal layer formed on the obverse face of the base body.

3. The cathode for an electron tube according to claim 2, wherein the electron emitting substance layer includes rare earth metal oxides.

4. The cathode for an electron tube according to claim 2, wherein both of the portions of the metal member formed on the obverse face and the reverse face of the base body are metal layers.

5. The cathode for an electron tube according to claim 2, wherein both of the portions of the metal member formed on the obverse face and the reverse face of the base body are metal powder layers.

6. The cathode for an electron tube according to claim 2, wherein one of the portions of the metal member formed on the obverse face and the reverse face of the base body is a metal layer and the other one thereof is a metal powder layer.

7. The cathode for an electron tube according to claim 1, wherein the metal member is formed to cover a portion of an obverse face of the base body and the electron emitting substance layer covers both of faces of the metal member and the obverse face of the base body.

8. The cathode for an electron tube according to claim 7, wherein the electron emitting substance layer includes rare earth metal oxides.

9. The cathode for an electron tube according to claim 7, wherein the metal member is formed at a substantially central portion of the base body.

10. The cathode for an electron tube according to claim 7, wherein the metal member is formed on the obverse face of the base by dispersing the metal member in a plurality of portions thereof.

11. The cathode for an electron tube according to claim 7, wherein the metal member uses a metal in a powder-like shape having a major component of the metal provided with a reducing power equivalent to or smaller than the reducing power of the at least one kind of reducing agents included in the base body and larger than the reducing power of nickel.

12. The cathode for an electron tube according to claim 7, wherein the metal member is a metal layer.

13. The cathode for an electron tube according to claim 7, wherein the metal member is subjected to a heat treatment in a temperature range of 800° C. through 1,200° C. after the metal member has been formed on the obverse face of the base body.

14. The cathode for an electron tube according to claim 1, wherein the metal with a reducing power is tungsten.

15. The cathode for an electron tube according to claim 14, wherein the depletion type semiconductor is $Ba+1/3Ba_3WO_6$.

16. An apparatus comprising:

an indirectly heated cathode for an electron tube including:

a base body having nickel as a major component and including at least one kind of reducing agent;

a metal member in a layer-like shape, said metal member having as a major component a metal provided with a reducing power equivalent to or smaller than a reducing power of the at least one kind of reducing agents included in the base body and larger than a reducing power of nickel and said metal member being formed on faces of the base body;

an electron emitting substance layer formed by depositing alkaline earth metal oxides including barium on the metal member;

wherein the metal member is formed on the faces of the base body such that the base body is restrained from deforming by thermal stresses of intermetallic compounds formed from diffusion of metals between the base body and the metal members on the faces thereof at portions of the base body bounded with the metal member, said reducing agent in said base body forming an interface between said metal member and said electron emitting substance layer which reacts with said alkaline earth metal oxides to further reduce a portion of the alkaline earth metal oxides and form an oxygen depletion-type semiconductor, thereby facilitating the emission of electrons.

17. The cathode for an electron tube according to claim 16, wherein the metal with a reducing power is tungsten.

18. The cathode for an electron tube according to claim 17, wherein the depletion type semiconductor is $Ba+1/3Ba_3WO_6$.

* * * * *